US006594841B2

(12) United States Patent
Broker et al.

(10) Patent No.: US 6,594,841 B2
(45) Date of Patent: Jul. 22, 2003

(54) UNBALANCE DETECTION SYSTEM FOR A WASHING MACHINE

(75) Inventors: John F. Broker, Colfax, IA (US); Douglas A. Ochsner, Newton, IA (US)

(73) Assignee: Maytag Corporation, Newton, IA (US)

( * ) Notice: Subject to any disclaimer, the term of this patent is extended or adjusted under 35 U.S.C. 154(b) by 97 days.

(21) Appl. No.: 09/956,904

(22) Filed: Sep. 21, 2001

(65) Prior Publication Data

US 2003/0056302 A1 Mar. 27, 2003

(51) Int. Cl.[7] ..... D06F 33/02
(52) U.S. Cl. ..... 8/159; 68/12.06; 68/12.12
(58) Field of Search ..... 8/159; 68/12.06, 68/12.12

(56) References Cited

U.S. PATENT DOCUMENTS

| | | | |
|---|---|---|---|
| 2,917,175 | A | 12/1959 | Toma |
| 4,765,161 | A | 8/1988 | Williamson |
| 4,862,710 | A | 9/1989 | Torita et al. |
| 5,161,393 | A | 11/1992 | Payne et al. |
| 5,301,522 | A | 4/1994 | Ikemizu et al. |
| 5,325,677 | A | 7/1994 | Payne et al. |
| 5,561,990 | A | 10/1996 | Berkcan et al. |
| 5,577,283 | A | 11/1996 | Badami et al. |
| 5,677,606 | A | 10/1997 | Otake |
| 5,682,634 | A | 11/1997 | Cheong et al. |
| 5,765,402 | A | 6/1998 | Ikeda et al. |
| 5,768,731 | A | 6/1998 | Do |
| 5,970,555 | A | 10/1999 | Baek et al. |
| 6,029,300 | A | 2/2000 | Kawaguchi et al. |
| 6,038,724 | A | 3/2000 | Chbat et al. |
| 6,047,428 | A | 4/2000 | Min |

FOREIGN PATENT DOCUMENTS

| | | |
|---|---|---|
| GB | 2124662 | 2/1984 |

*Primary Examiner*—Philip R. Coe
(74) *Attorney, Agent, or Firm*—Diederiks & Whitelaw, PLC

(57) ABSTRACT

An unbalance detection and control system senses an out-of-balance condition developed during a plaster speed portion of spin cycle in a washing machine, particularly a horizontal axis washing machine, through fluctuations in command signals sent from a main controller to maintain a spinning basket or tub of the washing machine at plaster speed. Preferably, the controller sends a pulse width modulated (PWM) signal to a drive controller which, in turn, regulates a motor used to spin the tub. A feedback loop is employed to reflect an actual operational state achieved by the spinning tub, which may warrant a change in the command signal. Excessive fluctuations in the command signals indicate a need to redistribute the load of clothes in the tub.

20 Claims, 3 Drawing Sheets

UNBALANCE DETECTION SYSTEM FOR A WASHING MACHINE

BACKGROUND OF THE INVENTION

1. Field of the Invention

The present invention pertains to the art of washing machines and, more particularly, to an unbalance detection system for a washing machine.

2. Discussion of the Prior Art

During operation of a washing machine, it is not uncommon for a tub or spinner of the machine to become unbalanced due to the particular distribution of a load of clothes therein. When the tub is rotated at a relatively high speed during an extraction phase of an overall washing cycle, an unbalanced condition can cause considerable vibrations of the entire machine. Since excessive vibrations can be detrimental to the continued reliability of the machine, it is known in the art to provide a vibration detection system for sensing an actual or incipient unbalance condition and for altering the operation of the machine when a predetermined threshold is reached. Typically, known systems function to either reduce the rotational speed of the clothes tub or entirely shut down the machine to counteract an unbalance condition.

In the art, various different vibration detection systems have been employed. For instance, it has been known to employ switches, such as mercury or micro-switches, which are engaged when excessive vibrations are encountered. Activation of these switches is relayed to a controller for altering the operational state of the machine. Other known systems provide electronic sensing systems to perform a corresponding function. For example, an unbalance condition which develops during a spin cycle can be sensing by sampling speed variations. However, the actual speed fluctuations can be slight, such that the speed based control needs to be tight, i.e., extremely sensitive and accurately controlled. On the other hand, torque based systems are also known as exemplified by U.S. Pat. Nos. 2,917,175 and 4,765,161. In such systems, motor current is sensed and used as a parameter related to motor torque. However, given that the actual current value can fluctuate based on various factors and such systems typically require the inclusion of an additional sensor for sending current signals which are averaged over a certain period of time or number of basket revolutions, shortcomings can exist in at least the cost and precision of such systems.

In any event, there exists a need in the art for an unbalance detection system for a washing machine, particularly a horizontal axis washing machine, which can effectively, efficiently and accurately sense an unbalance condition. Furthermore, there exists a need for an improved unbalance detection system which is simple in construction and operation, so as to be reliable and cost effective.

SUMMARY OF THE INVENTION

A washing machine constructed in accordance with the present invention incorporates a system for controlling either an actual or incipient unbalance condition in a reliable, accurate and cost effective manner. More specifically, the present invention is directed to an unbalance detection system for a washing machine, particularly a horizontal axis washing machine, which can sense an unbalance condition through fluctuations in command control signals sent to a motor controller for a basket of the washing machine spinning at a plaster speed.

More particularly, the washing basket or tub of a tumble-type washing machine is rotated at a predetermined speed, i.e., in the order of 85 rpm in accordance with the most preferred form of the invention, during a portion of a spin cycle. During this portion of the spin cycle, clothes located in the washing tub are plastered against the annular inner wall surface of the tub wherein water is extracted from the clothes and directed to a drain. To achieve the desired spin speed, a main electronic controller provides a pulse width modulated (PWM) command signal to a drive motor controller for the washing tub. In return, the motor control sends feedback signals to the main controller regarding the rpm achieved for each revolution of the tub. The actual PWM signal is directly for each revolution of the tub. The actual PWM signal is directly proportional to the torque at the drive motor such that, if imbalances occur, torque variations will exist. That is, if an unbalanced load is to be lifted during rotation of a horizontal axis washing tub, a large torque will be needed. When the load drops, the torque will be considerably smaller. Fluctuations in the PWM command signal are sensed in accordance with the unbalance detection system of the present invention in order to reflect these torque variations. If a predetermined unbalance condition arises, spinning of the washing tub is terminated, the load in the tub is tumbled to redistribute the load and then the spin cycle is again attempted.

With this construction and operation, a relatively simple, inexpensive and effective unbalance detection system for a washing machine is provided. In any event, additional objects, features and advantages of the invention will become more readily apparent from the following detailed description of a preferred embodiment of the invention, when taken in conjunction with the drawings wherein like reference numerals refer to corresponding parts in the several views.

DETAILED DESCRIPTION OF A PREFERRED EMBODIMENT

Figure 1:
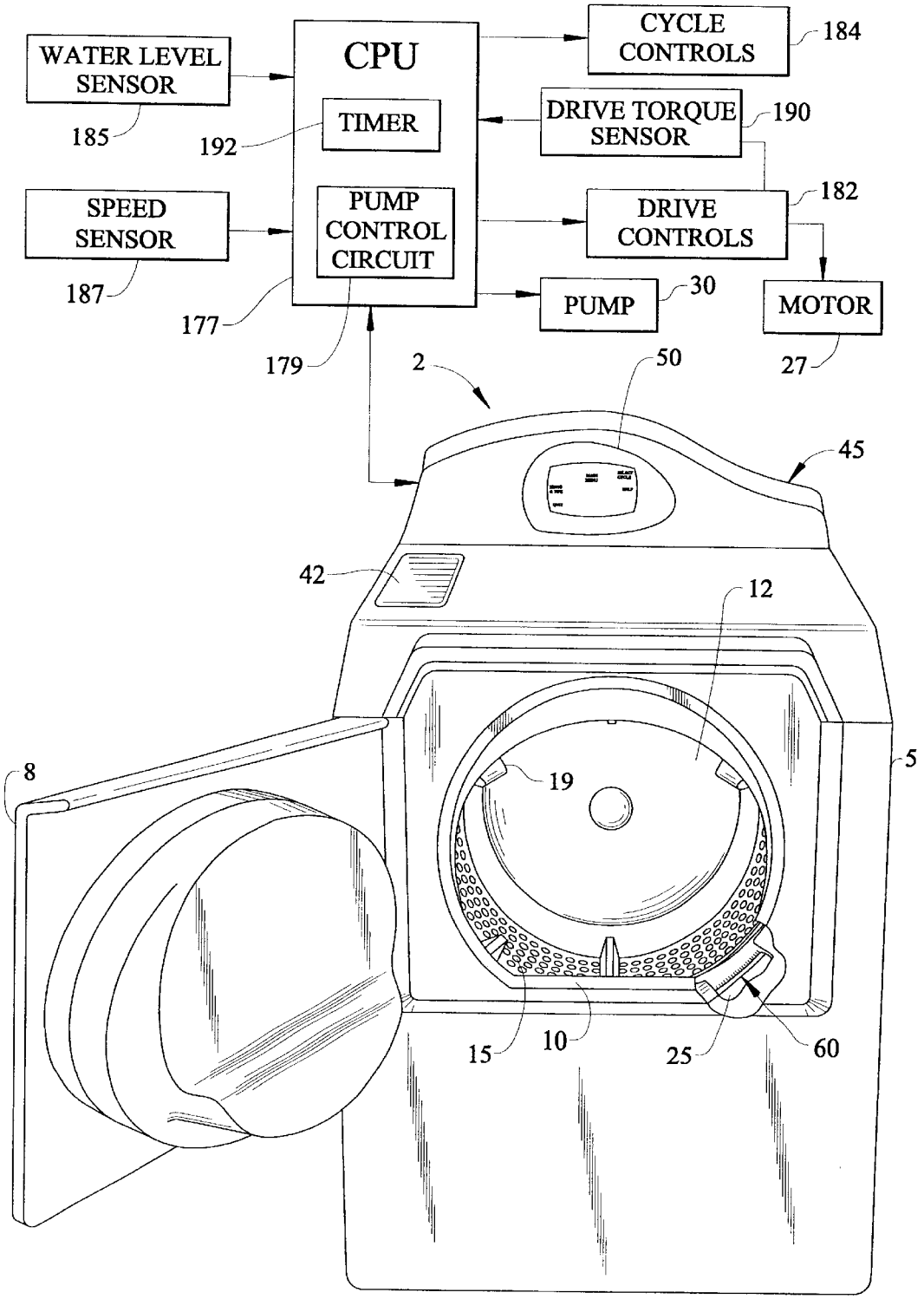
FIG. 1 is a partially cut-away, perspective view of a horizontal axis washing machine incorporating an unbalance detection system according to the invention.

With initial reference to FIG. 1, an automatic horizontal axis washing machine incorporating the unbalance detection system of the present invention is generally indicated at 2. In a manner known in the art, washing machine 2 is adapted to be front loaded with articles of clothing to be laundered through a tumble-type washing operation. As shown, automatic washing machine 2 incorporates an outer cabinet shell 5 provided with a front door 8 adapted to extend across an access opening 10. Front door 8 can be selectively pivoted to provide access to an inner tub or spinner 12 that constitutes a washing basket within which the articles of clothing are laundered.

Figure 2:
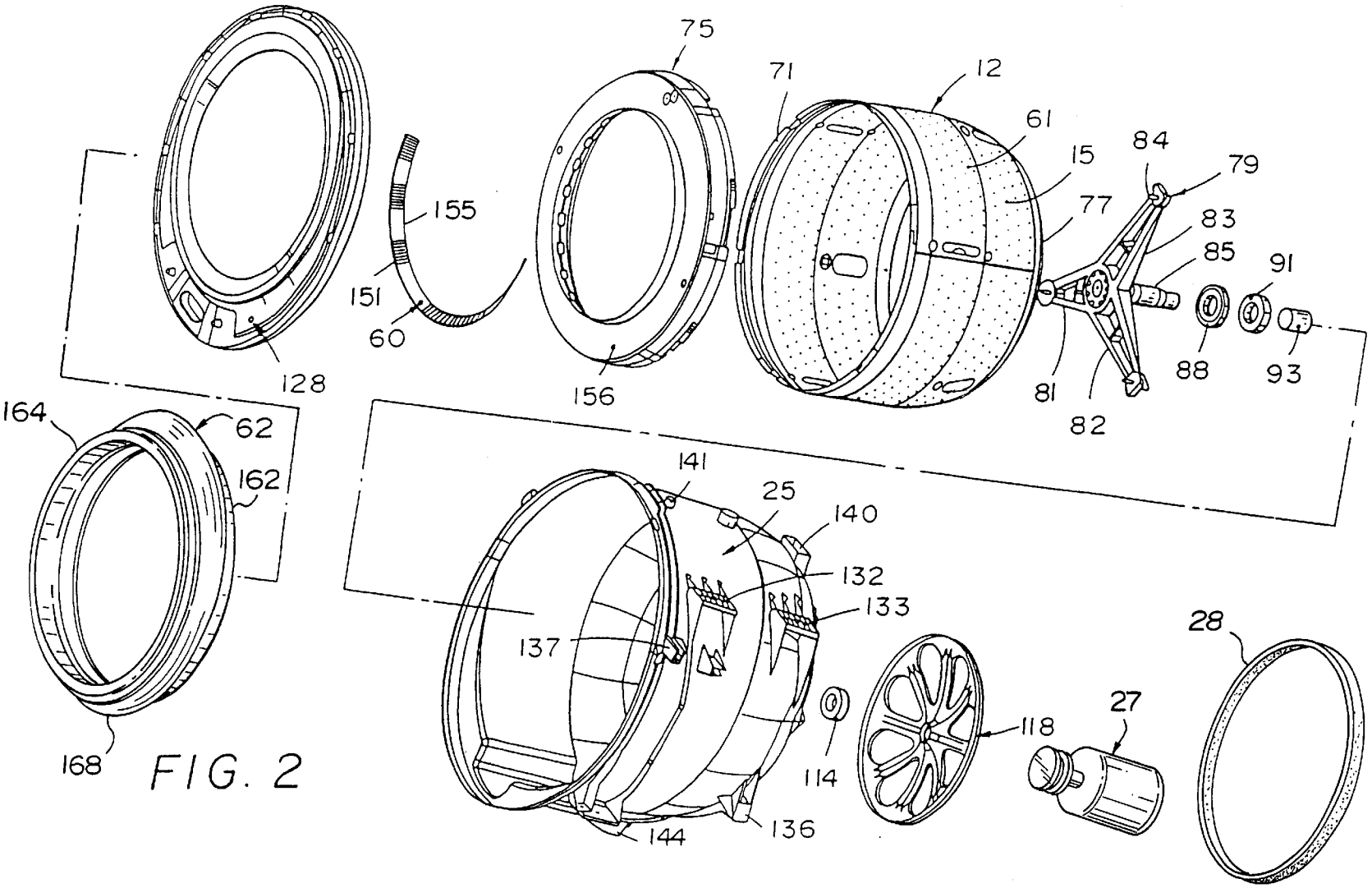
FIG. 2 is an exploded view of various internal components of the washing machine of FIG. 1.
Figure 3:
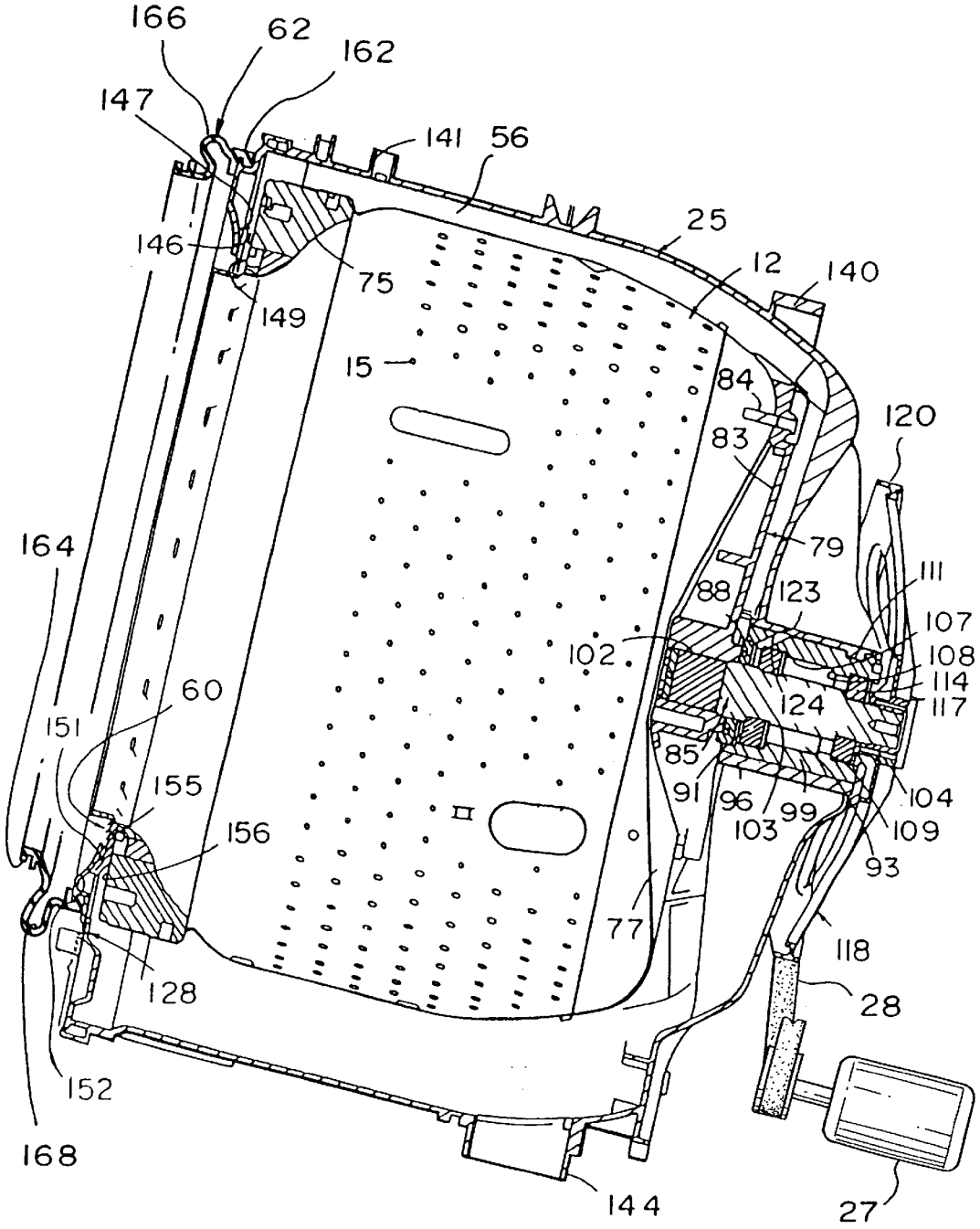
FIG. 3 is a cross-sectional view of the internal components of FIG. 2 in an assembled state.

As is known in the art, inner tub 12 is formed with a plurality of holes 15 and multiple, radially inwardly projecting fins or blades 19 are fixedly secured to inner tub 12. Inner tub 12 is mounted for rotation within an outer tub 25, which is supported through a suspension mechanism (not shown) within cabinet shell 5. Inner tub 12 is mounted within cabinet shell 5 for rotation about a generally horizontal axis. Actually, the rotational axis is angled slightly downwardly and rearwardly as generally represented in FIG. 3. A motor 27, preferably constituted by a variable speed, reversible electric motor, is mounted within cabinet shell 5 and adapted to drive inner tub 12 through a belt 28 FIGS. 2 and 3). More specifically, inner tub 12 is rotated during both wash and rinse cycles such that articles of clothing placed therein actually tumble through either water, water/detergent or another washing medium supplied within inner tub 12. Given that inner tub 12 is provided with at least the plurality of holes 15, the water or water/detergent can flow between the inner and outer tubs 12 and 25. A pumping system (not shown) is provided to control the level of washing fluid within machine 2, with one pump particularly controlling the timed draining of the fluid from the outer tub 25.

Since programming aspects of washing machine 2 are not considered part of the present invention, they will not be discussed in detail here. However, in general, washing machine 2 incorporates a central processing unit or CPU 20 which functions to output signals to both tub drive controls 30 and cycle controls 40 to establish a desired washing operation. Again, this structure is known in the art for use in controlling a normal washing operation for automatic washing machine 2. Automatic washing machine 2 is also shown to include an upper cover 42 that provides access to an area for adding detergent, softeners and the like. An upper control panel 45 includes a touch display 50 through which a user can program washing machine 2. As will become more fully evident below, the particular construction of washing machine 2 can significantly vary in accordance with the present invention. In the preferred embodiment shown, display 50 includes a plurality of selectable control areas or zones which can be accessed by a user to both program and operate washing machine 2. In the most preferred form of the invention, display 50 takes the form of an LCD display, such as a 128×96 dot matrix, touch screen display, which enables a user to readily review displayed data, preferably in alpha or word text format, and select from that data to establish and begin a desired washing operation. Display 50 could have the selectable areas 15 at any location on the display. The manner in which washing machine 2 can be programmed is disclosed in U.S. patent application Ser. No. 09/741,067 entitled "Interactive Control System for a Laundry Appliance", filed on Dec. 21, 2000 and incorporated herein by reference.

In order to allow inner tub 12 to freely rotate within outer tub 25 during a given washing operation, inner tub 12 is spaced concentrically within outer tub 25 in the manner which will be detailed more fully below. This spacing establishes an annular gap 56 (see FIG. 3) between the inner and outer tubs 12 and 25. A flexible sealing device, generally indicated at 60 in FIGS. 1 and 3, functions to bridge this gap between inner and outer tubs 12 and 25 to prevent such objects from flowing into the outer tub 25. Further provided as part of washing machine 2 in a manner known in the art is a sealing boot 62 (see FIGS. 2 and 3) which extends generally between outer tub 25 and a frontal panel portion (not separately labeled) of cabinet shell 5. Reference now will be made to FIGS. 2 and 3 in describing the preferred mounting of inner tub 12 within outer tub 25 and the arrangement of both sealing device 60 and sealing boot 62.

Inner tub 12 has an annular side wall 61 and an open front rim 71 about which is secured a balance ring 75. In the preferred embodiment, balance ring 75 is injection molded from plastic, such as polypropylene, with the balance ring 75 being preferably mechanically attached to rim 71. Inner tub 12 also includes a rear wall 77 to which is fixedly secured a spinner support 79. More specifically, spinner support 79 includes a plurality of radially extending arms 81–83 which are fixedly secured to rear wall 77 by means of screws 84 or the like. Spinner support 79 has associated therewith a driveshaft 85. Placed upon driveshaft 85 is an annular lip seal 88. Next, a first bearing unit 91 is press-fit onto driveshaft 85. Thereafter a bearing spacer 93 is inserted upon driveshaft 85.

The mounting of inner tub 12 within outer tub 25 includes initially placing the assembly of inner tub 12, balance ring 75, spinner support 79, lip seal 88, first bearing unit 91 and bearing spacer 93 within outer tub 25 with driveshaft 85 projecting through a central sleeve 96 formed at the rear of outer tub 25. More specifically, a metal journal member 99 is arranged within central sleeve 96, with central sleeve 96 being preferably molded about journal member 99. Therefore, driveshaft 85 projects through journal member 99 and actually includes first, second and third diametric portions 102–104. In a similar manner, journal member 99 includes various diametric portions which define first, second and third shoulders 107–109. Journal member 99 also includes an outer recess 111 into which the plastic material used to form outer tub 25 flows to aid in integrally connecting journal member 99 with outer tub 25.

As best shown in FIG. 3, the positioning of driveshaft 85 in journal member 99 causes each of annular lip seal 88, first bearing 91 and bearing spacer 93 to be received within journal member 99. More specifically, annular lip seal 88 will be arranged between first diametric portion 102 of driveshaft 85 and journal member 99. First bearing unit 91 will be axially captured between the juncture of first and second diametric portions 102 and 103, as well as first shoulder 107. Bearing spacer 93 becomes axially positioned between first bearing unit 91 and second shoulder 108 of journal member 99. Thereafter, a second bearing unit 114 is placed about driveshaft 85 and inserted into journal member 99, preferably in a press-fit manner, with second bearing unit 114 being seated upon third shoulder 109. At this point, a hub 117 of a spinner pulley 118 is fixedly secured to a terminal end of driveshaft 85 and axially retains second bearing unit 114 in position. Spinner pulley 118 includes an outer peripheral surface 120 which is adapted to be connected to belt 28 driven in a controlled fashion by reversible motor 20 mentioned above in order to rotate inner tub 12 during operation of washing machine 2. In order to provide lubrication to lip seal 88, central sleeve 96 is formed with a bore 123 that is aligned with a passageway 124 formed in journal member 99.

Outer tub 25 has associated therewith a tub cover 128. More specifically, once inner tub 12 is properly mounted within outer tub 25, tub cover 128 is fixedly secured about the open frontal zone of outer tub 25. Although the materials for the components discussed above may vary without departing from the spirit of the invention, outer tub 25, balance ring 75 and tub cover 128 are preferably molded from plastic, while inner tub 12 is preferably formed of stainless steel. Again, these materials can vary without departing from the spirit of the invention. For example, inner tub 12 could also be molded of plastic.

Outer tub 25 is best shown in FIG. 2 to include a plurality of balance weight mounting gusset platforms 132 and 133, a rear mounting boss 136 and a front mounting support 137. It should be realized that commensurate structure is provided on an opposing side portion of outer tub 25. In any event, balance weight mounting platforms 132 and 133, mounting boss 136, mounting support 137 and further mounting boss 140 are utilized in mounting outer tub 25 within cabinet shell 5 in a suspended fashion. Again, the specific manner in which outer tub 25 is mounted within cabinet shell 5 is not considered part of the present invention, so it will not be described further herein. Outer tub 25 is also provided with a fluid inlet port 141 through which washing fluid, i.e., either water, water/detergent or the like, can be delivered into outer tub 25 and, subsequently, into inner tub 12 in the manner discussed above. Furthermore, outer tub 25 is formed with a drain port 144 which is adapted to be connected to a pump for draining the washing fluid from within inner and outer tubs 12 and 25 during certain cycles of a washing operation.

As best illustrated in FIG. 3, inner tub 12 is entirely spaced from outer tub 25 for free rotation therein. This spaced relationship also exists at the front ends of inner and outer tubs 12 and 25 such that an annular gap 146 is defined between an open frontal zone 147 of outer tub 25 and an open frontal portion 149 associated with balance ring 75. It is through a lower section of gap 146 that washing fluid can also flow from within inner tub 12 to outer tub 25.

Flexible sealing device 60 is mounted so as to bridge gap 146 between inner and outer tubs 12 and 25 and, specifically, between balance ring 75 and tub cover 128. Gap 146 is required because of deflections between inner tub 12 and outer tub 25 during operation of washing machine 2. Sealing device 60 bridges gap 146 to prevent small items from passing through, but sealing device 60 is flexible so as to accommodate changes in the size of gap 146 resulting from deflections during operation. Sealing device 60 includes a first seal portion 151 that is fixed or otherwise secured to a rear or inner surface 152 of tub cover 128 and a second, flexible seal portion 155, such as brush bristles or a plastic film, which projects axially across gap 146 and is placed in close proximity and most preferably in sliding contact with a front or outer surface 156 of balance ring 75. As is also known in the art, sealing boot 62 includes an inner annular end 162 which is fixed sealed to tub cover 128, an outer annular end 164 which is fixed to the front cabinet panel (not separately labeled) of cabinet shell 5 and a central, flexible portion 166. As perhaps best shown in FIG. 3, flexible portion 166 actually defines a trough 168.

In general, various wash cycles can be selected through display 50, including "Normal", "Extra Rinse" and "Stain Removal" cycles. During a normal washing operation, automatic washing machine 2 will proceed through a main wash cycle and a predetermined number of rinse cycles. In the main wash cycle, a preset amount of water is added to any detergent or other washing solution supplied in the areas beneath cover 42 and inner tub or spinner 12 is driven to tumble articles of clothing through the resulting solution. Periodically, it is preferable to alter the rotational direction of inner tub 12 during this period to vary the tumbling pattern.

After the wash cycle tumbling time period has elapsed, a drain cycle is initiated with a continued tumbling action. In the preferred embodiment, this tumble drain period lasts approximately 90 seconds. Following the tumble drain, inner tub 12 is subjected to a spin mode wherein inner tub 12 spins for approximately two minutes. At this point, the water/detergent solution has been substantially removed from within inner tub 12, although the articles of clothing will certainly still possess a certain percentage of the solution. Next, the articles of clothing are subjected to the predetermined number of rinse cycles wherein inner tub 12 is filled to a predetermined level with water and placed in a rinse cycle tumble pattern. In the most preferred form, three rinse cycles are provided. In general, each of the rinse cycles sequentially incorporate a rinsing tumble mode, followed by a tumble drain, a pause drain and then a rinse cycle spin mode. Thereafter, a final draining occurs and inner tub 12 is allowed to coast to a stop position and the washing operation is completed. Further details of this overall operational sequence is described in commonly assigned U.S. Pat. No. 6,241,782 entitled "Horizontal Axis Washing Machine Incorporating Flush Tumble Cycle" issued Jun. 5, 2001, which is hereby incorporated by reference.

At this point, it should again be realized that the specific washing operation described above, including the specific speeds and times established for the various modes of operation are presented for the sake of completeness only and should not be considered limiting to the present invention. Instead, it is the manner in which the system of the present invention detects an unbalance condition in connection with a load of clothes in inner tub 12 during a spin cycle of operation which is of concern to the present invention. More specifically, inner tub 12 of washing machine 2 is rotated at a desired, relatively high speed during a spin cycle. In reaching the actual spin speed, inner tub 12 goes through a plaster speed. Although this speed can vary, the plaster speed is in the order of 85 rpm in accordance with the most preferred form of the invention. Therefore, at this speed, clothes located in inner tub 12 are plastered against the annular inner wall surface (not separately labeled) of tub 12 wherein water extraction from the clothes is initiated. To achieve and maintain the desired spin speed for an unbalance detection period, CPU 20 provides a command signal, preferably a pulse width modulated (PWM) command signal, to drive controls 30 to, in essence, instruct drive controls 30 to regulate motor 27 so as to achieve the desired plaster speed for inner tub 12. In return, drive controls 30 sends feedback signals on line 175 to CPU 20 regarding the rpm's achieved. The actual PWM signal is related to the torque needed at drive motor 27 to achieve the plaster speed. If imbalances occur, torque variations will exist. That is, if an unbalanced load is to be lifted during rotation of a inner tub 12, a large torque will be needed. When the load drops, the torque will be considerably smaller. Regardless, the tach signals received by CPU 20 through line 175 are used to re-establish a suitable command signal back to drive controls 30, with the command signal being set to maintain the plaster speed. Any fluctuations in the PWM command signal are sensed in accordance with the detection system of the present invention in order to detect unbalanced load conditions. Most preferably, the sinusoidal portions of the fluctuations are considered in the evaluation.

In accordance with the most preferred embodiment of the invention, when an unbalance condition is sensed, the rotation of inner tub 12 is terminated through motor drive controls 30. Thereafter, inner tub 12 is tumbled in an attempt to redistribute the load of clothes. For this purpose, inner tub 12 is preferably tumbled in an opposing rotational direction through drive motor 27. In accordance with the most preferred form of the invention, this overall redistribution operation takes in the order of 9 seconds, with the tumbling operation accounting for about 6 seconds of this time period. After this redistribution operation is completed, washing machine 2 again attempts the desired spin cycle. If necessary, the redistribution operation is repeated a number of times, e.g. twenty times, prior to simply terminating the overall washing operation due to an inability to adequately redistribute the load of clothes.

In this sense, the invention provides for a relatively simple, inexpensive and effective unbalance detection system for washing machine 2. That is, in accordance with the invention, the need for any current sensor is avoided, along with any special program for averaging and/or converting sensed current values to a useable format. Most preferably, the command signal to drive controls 30 is sensed every revolution of inner tub 12 in order to accurately and expeditiously enable any developed unbalance condition to be counteracted. Although described with reference to a preferred embodiment of the invention, it should be readily understood that various changes and/or modifications can be made to the invention without departing from the spirit thereof. For instance, although a tach signal is used in the feedback loop from the motor drive controls 30 to CPU 20, other sensing arrangements could be employed. Preferably an arrangement which receives coil/winding signals to sense rotor position is employed, but an optical eye-type tach system could be used. In addition, it should be recognized that the actual fluctuations permitted prior to designating an unbalance condition can vary, particularly depending on the overall suspension incorporated into washing machine 2. In accordance with the most preferred form of the present invention, a ½ pound to 4 pound (½ lb. to 4 lb.) unbalanced load test was conducted in connection with establishing the critical level of fluctuations. It is also possible in accordance with the present invention to provide a target command signal to drive controls 30 and measure fluctuations in control signals from drive controls 30 to motor 27 determine machine imbalance in accordance with the invention. In any event, the invention is only intended to be limited by the scope of the following claims.

We claim:

1. A washing machine comprising:

a cabinet shell;

an inner tub mounted within the cabinet shell for rotation during predetermined intervals in an overall washing operation including at least one spin cycle;

a drive motor for rotating the inner tub;

a drive controller for regulating an operational state of the drive motor;

a main controller providing command signals to the drive controller; and means for detecting an unbalance condition in the washing machine by monitoring fluctuations in the command signals sent to the drive controller from the main controller.

2. The washing machine according to claim 1, wherein said detecting means monitors for fluctuations in the command signals upon each revolution of the inner tub.

3. The washing machine according to claim 1, wherein the detecting means includes a feedback loop from the drive controller to the main controller for signaling an operational parameter of the drive motor.

4. The washing machine according to claim 3, wherein the operational parameter constitutes a signal from the drive controller indicative of a rotational speed of the inner tub.

5. The washing machine according to claim 4, wherein said inner tub is adapted to receive a load of laundry and rotate about a substantially horizontal axis so as to subject the laundry to a tumbling-type washing action.

6. The washing machine according to claim 5, wherein the command signals function to establish a substantially constant plaster speed of rotation for the inner tub during an unbalance detection period of the at least one spin cycle.

7. The washing machine according to claim 6, wherein the plaster speed is approximately 85 rpm.

8. The washing machine according to claim 1, wherein the command signals are constituted by pulse width modulation signals.

9. A washing machine comprising:

a cabinet shell;

an inner tub mounted within the cabinet shell for rotation during predetermined intervals in an overall washing operation which includes at least one spin cycle;

a drive motor for rotating the inner tub; and an unbalance detection system including means for providing command signals to rotate the inner tub through said drive motor and means for monitoring for fluctuations in the command signals, wherein an unbalance condition is determined when the fluctuations exceed a predetermined level.

10. The washing machine according to claim 9, wherein said monitoring means is responsive to fluctuations in the command signals for each revolution of the inner tub.

11. The washing machine according to claim 9, further comprising: a drive controller for regulating an operational state of the drive motor, said command signals being sent to the drive controller.

12. The washing machine according to claim 11, wherein the detection system further includes a feedback loop from the drive controller to the means for providing the command signals for signaling an operational parameter of the drive motor.

13. The washing machine according to claim 12, wherein the operational parameter constitutes a signal from the drive controller indicative of a rotational speed of the inner tub.

14. The washing machine according to claim 13, wherein the command signals function to establish a substantially constant plaster speed of rotation for the inner tub during an unbalance detection period of the at least one spin cycle.

15. The washing machine according to claim 14, wherein the plaster speed is approximately 85 rpm.

16. The washing machine according to claim 9, wherein the command signals are constituted by pulse width modulation signals.

17. A method of detecting an unbalance condition in a washing machine having an inner tub which is rotatable by a drive motor comprising:

monitoring for fluctuations in command signals sent from a controller to establish a desired operating state of the drive motor during a spin operation of the washing machine;

determining the existence of an unbalance condition when the fluctuations exceed a predetermined level; and altering the spin operation of the washing machine based on the sensing of the unbalance condition.

18. The method according to claim 17, further comprising:

providing a feedback loop signal indicative of an operational parameter of the drive motor; and altering the command signals based on the feedback loop signal.

19. The method according to claim 17, further comprising: issuing the command signals to maintain the inner tub at a substantially constant speed.

20. The method according to claim 17, further comprising: monitoring for fluctuations upon each revolution of the inner tub.

* * * * *